US007774868B2

(12) United States Patent
Landsberger et al.

(10) Patent No.: US 7,774,868 B2
(45) Date of Patent: Aug. 17, 2010

(54) TOILET SEAT ELEVATOR ASSEMBLY

(75) Inventors: David Landsberger, Caldwell, NJ (US); Paul Thom, Butler, NJ (US); Francis Gomes, Lincoln Park, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 489 days.

(21) Appl. No.: 11/827,836

(22) Filed: Jul. 12, 2007

(65) Prior Publication Data

US 2009/0013453 A1 Jan. 15, 2009

(51) Int. Cl.
*A47K 13/00* (2006.01)

(52) U.S. Cl. ..... 4/237; 4/236; 4/240; 4/239

(58) Field of Classification Search ..... 4/234–240
See application file for complete search history.

(56) References Cited

U.S. PATENT DOCUMENTS

| | | | | |
|---|---|---|---|---|
| 534,018 | A | 2/1895 | Stevens, Jr. | |
| 559,478 | A | 5/1896 | Bunting, Jr. | |
| 1,784,630 | A | 12/1930 | Johnson | |
| 2,181,017 | A | 11/1939 | Hill | |
| 2,221,991 | A | 11/1940 | Myers | |
| 2,535,789 | A | 12/1950 | Bell | |
| 2,852,786 | A | 9/1958 | Reinhard | |
| 2,901,753 | A | 9/1959 | Sperzel | |
| 2,980,922 | A * | 4/1961 | Taylor | 4/235 |
| 3,550,164 | A | 12/1970 | Pease | |
| 3,557,393 | A | 1/1971 | Waldon | |
| 3,670,441 | A * | 6/1972 | Blount | 4/236 |
| 4,148,104 | A | 4/1979 | Ginsburg | |
| 4,159,548 | A | 7/1979 | Hewson | |
| 4,173,802 | A | 11/1979 | Wikstrom | |
| 4,213,211 | A * | 7/1980 | Bemis et al. | 4/239 |
| 4,314,382 | A | 2/1982 | Ginsburg et al. | |
| 4,367,567 | A | 1/1983 | Sendoykas | |
| 4,467,481 | A | 8/1984 | Ginsburg | |
| 4,534,072 | A | 8/1985 | Lipski | |
| 4,589,148 | A | 5/1986 | Cameron | |
| 4,635,303 | A | 1/1987 | Shih | |
| 4,688,274 | A | 8/1987 | Grimstad | |
| 4,729,134 | A | 3/1988 | Hillebrand et al. | |
| 4,893,360 | A | 1/1990 | Wofford | |
| 4,965,889 | A * | 10/1990 | Tissot et al. | 4/234 |
| 4,974,262 | A | 12/1990 | Rosen | |
| 4,985,939 | A | 1/1991 | Otte | |

(Continued)

OTHER PUBLICATIONS

Maddak Inc., 2005 Catalog pp. 26-31.

*Primary Examiner*—Khoa D Huynh
(74) *Attorney, Agent, or Firm*—Lowenstein Sandler PC

(57) ABSTRACT

A toilet seat elevator assembly includes a mounting bracket for connection to a toilet bowl and a seat elevator removably connected to the mounting bracket. The seat elevator has a generally ring-shaped portion for resting on the toilet bowl and a mounting portion with opposing mounting projections. The mounting bracket has a pair of opposing side panels and an elongate slot formed in each side panel. Each elongate slot is adapted for slidably and rotatably receiving the mounting projections of the mounting portion, so that the seat elevator may be slidably and rotatably mounted to the bracket to facilitate installation, adjustment and removal of the seat elevator with respect to the toilet bowl.

11 Claims, 11 Drawing Sheets

U.S. PATENT DOCUMENTS

| | | | | |
|---|---|---|---|---|
| RE33,554 | E | 3/1991 | Stewart | |
| 5,142,740 | A | 9/1992 | Amaki | |
| 5,251,338 | A | 10/1993 | Light | |
| 5,414,875 | A | 5/1995 | Kappl | |
| 5,448,781 | A | 9/1995 | Miller | |
| D370,252 | S | 5/1996 | Hulsebus | |
| 5,631,789 | A | 5/1997 | Dion | |
| 5,638,554 | A | 6/1997 | Corzine | |
| 5,708,989 | A * | 1/1998 | Ellis | 4/237 |
| 5,915,845 | A * | 6/1999 | Lee | 4/237 |
| 5,918,321 | A | 7/1999 | Olle | |
| 5,920,917 | A | 7/1999 | Landsberger | |
| 6,052,869 | A | 4/2000 | Suzuki | |
| 6,381,762 | B1 | 5/2002 | Moser | |
| 6,389,611 | B2 | 5/2002 | Fujita | |
| 6,393,623 | B1 | 5/2002 | Strickland, Jr. | |
| 6,418,566 | B1 | 7/2002 | Plonta | |
| 6,658,672 | B2 | 12/2003 | Hsieh | |
| 6,751,826 | B2 | 6/2004 | Miller | |
| 6,807,686 | B1 | 10/2004 | Janes | |
| 6,826,803 | B2 | 12/2004 | Twomey | |
| D510,253 | S | 10/2005 | Twomey | |
| 2008/0276358 | A1 * | 11/2008 | Allen et al. | 4/240 |

* cited by examiner

TOILET SEAT ELEVATOR ASSEMBLY

FIELD OF THE INVENTION

The present invention relates generally to toilet seat elevators, and more particularly to a toilet seat elevator assembly that is easily installed and removed with respect to a toilet bowl.

BACKGROUND OF THE INVENTION

Over the years, toilet bowls have been manufactured in many different sizes and shapes. More recently, the plumbing industry has become conscious of the necessity for the interchangeability of products and thus the dimensions of the bowl have become increasingly limited by consensus standards. One of the standards dictates that the seat on a toilet bowl, when in a horizontal or lowered position, be located between 15 and 16 inches above the floor. The conventional 15-16 inch toilet seat height is common for both residential and commercial bowls and is generally adapted to accommodate needs of the majority of people.

However, many people with physical limitations and disabilities have difficulty accessing the toilet seat at the conventional height and thus require a seat which is raised 1-5 inches or higher comparative to standards. To meet this need, various seat elevator arrangements have been developed. These elevators raise the level of the horizontal seat and reduce the human body bending required to effectively use the bowl.

Toilet bowl elevators of various sorts have been commercially available for many years. Many of these elevators must be attached to the bowl in such a way that the bowl is restricted in its use or the elevator simply sits on the bowl. Elevators that are permanently attached or bolted to the bowl either through the conventional seat attachment holes or to the annular rim around the top of the bowl create many areas between the bowl and the elevator which are difficult to clean, while adding moisture and dirt collecting areas in the elevator itself. The result is an unsanitary manner by which the elevators are attached to the toilet bowl. By permanently attaching the elevator to the rim or tail of the bowl, its use is thereafter restricted to seated endeavors. In this manner, the possible utilization of the bowl as a standing urinal for the male users becomes very difficult or is totally eliminated.

The prior art seat elevators that merely sit on the bowl or are attached by clips, so as to be removed for cleaning, tend to be unstable in use. It should be noted that in view of the limitations of persons disposed to use toilet elevators, stability and security are of primary importance. Another serious drawback of the conventional elevators is that in view of the typically permanent attachment to the bowl, adjustment of the elevator with respect to the bowl is often not possible. This makes it difficult to adapt usage of the same elevator to various sizes and configurations of the bowls. In view of the above, it has been a long felt and unsolved need for a toilet seat elevator which can be easily attached to or removed from a bowl so as to simplify cleaning and replacement as well as facilitate use of the elevator with bowls of various configurations

BRIEF SUMMARY OF THE INVENTION

According to one aspect of the invention, a toilet seat elevator assembly includes a seat elevator with a generally ring-shaped portion for resting on a toilet bowl and a mounting portion extending rearwardly of the ring-shaped portion. The mounting portion has opposing mounting projections.

The assembly further includes a bracket with a bottom wall adapted for securement to the toilet bowl and spaced side panels that extend upwardly from the bottom wall. Each said side panel has forward and rear edges that extend upwardly from the bottom wall, an upper edge that extends between the forward and rear edges, and an elongate slot that extends within each side panel between the forward and rear edges. Each elongate slot is adapted for slidably and rotatably receiving the mounting projections of the mounting portion, so that the seat elevator may be slidably and rotatably mounted to the bracket to thereby facilitate adjustment and removal of the seat elevator with respect to the toilet bowl.

According to a further aspect of the invention, a toilet seat elevator assembly includes a seat elevator and a bracket for removably connecting the seat elevator to a toilet bowl. The seat elevator has a generally ring-shaped portion for resting on the toilet bowl and a mounting portion that extends rearwardly of the ring-shaped portion. The mounting portion has opposing mounting projections. The bracket includes a bottom wall that is adapted for securement to the toilet bowl and spaced side panels that extend upwardly from the bottom wall. Each side panel has forward and rear edges extending upwardly from the bottom wall and an upper edge extending between the forward and rear edges, an elongate slot extending from a first slot position proximal the upper and forward edges to a second slot position proximal the rear edge and bottom wall, a first slot segment extending from the upper edge to the elongate slot for receiving one of the mounting projections during installation of the mounting portion of the seat elevator on the bracket, and a second slot segment spaced rearwardly of the first slot segment. The second slot segment extends toward the upper edge from the elongate slot. Each mounting projection is positioned in its respective second slot segment when the toilet seat elevator is in a lowered position on the toilet bowl to thereby secure the seat elevator against sliding movement along the elongate slot when in use.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical or exemplary embodiments of the invention and thus may not be necessarily to scale. Accordingly, the drawings should not be considered as limiting the scope of the invention. The invention will now be described in greater detail with reference to the accompanying drawings.

DETAILED DESCRIPTION OF THE INVENTION

Figure 1:
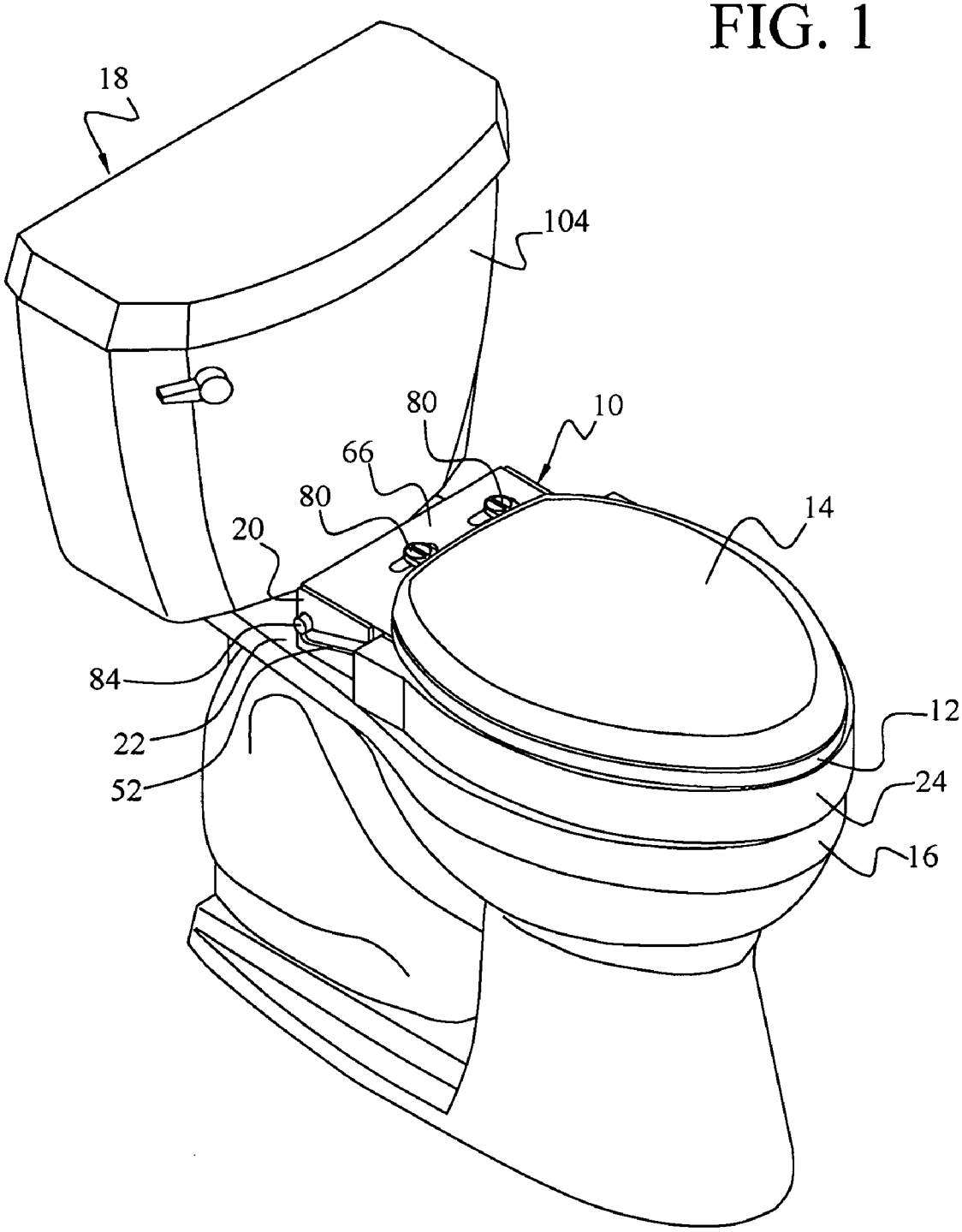
FIG. 1 is an isometric view of a toilet seat elevator assembly mounted on a conventional toilet in accordance with the present invention.
Figure 2:
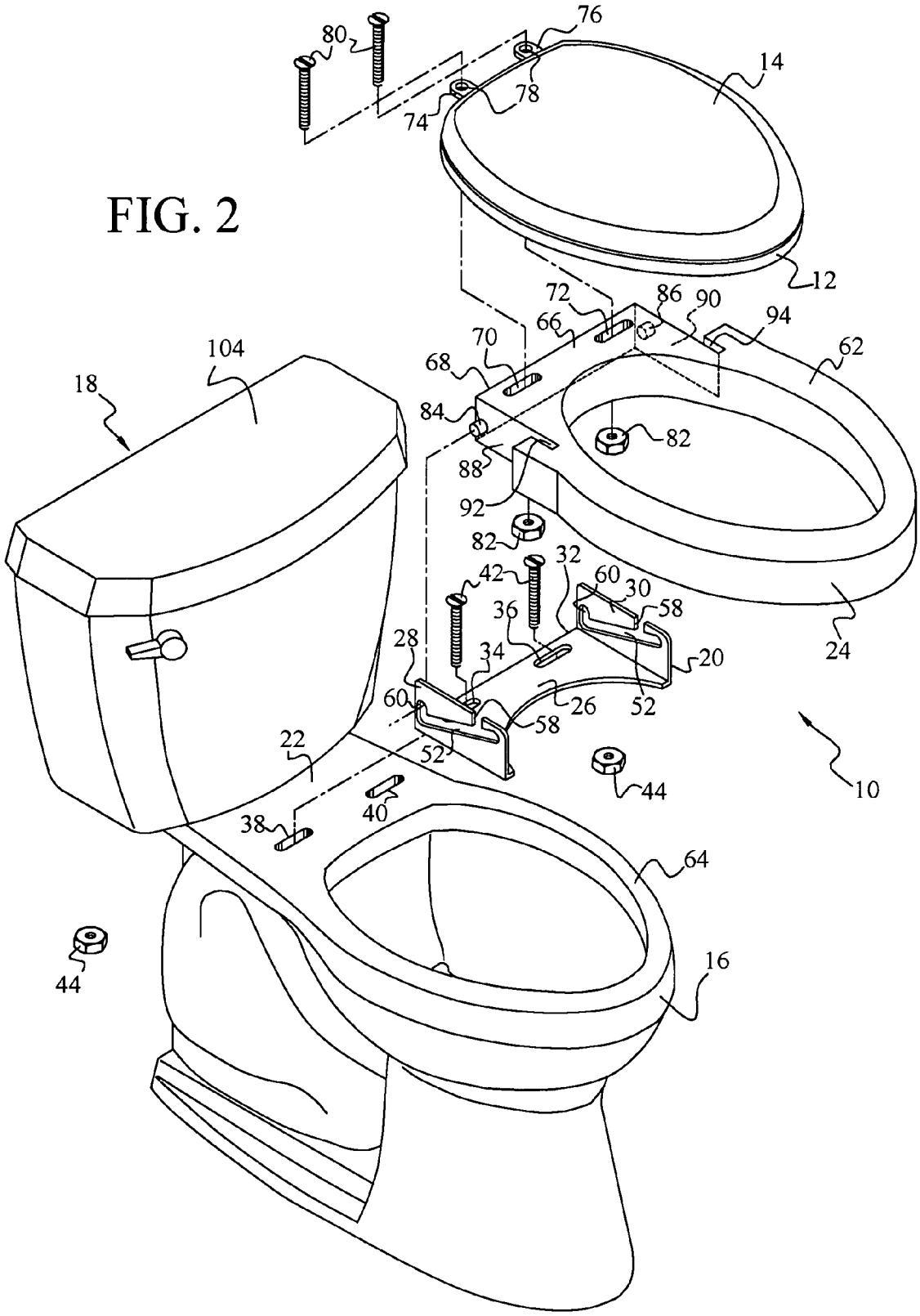
FIG. 2 is an exploded isometric view of the elevator assembly of FIG. 1 for mounting to the toilet.

Referring to the drawings and to FIGS. 1 and 2 in particular, a toilet seat elevator assembly 10 in accordance with an exemplary embodiment of the present invention is illustrated. The elevator assembly 10 serves to increase the height of a conventional toilet seat 12 and lid 14 with respect to a toilet bowl 16 of a conventional toilet 18 to accommodate users who may otherwise experience difficulty with toilet seats of conventional height. The elevator assembly 10 preferably includes a mounting bracket 20 connected to a seat mounting area 22 of the toilet bowl 16 and a seat elevator 24 removably connected to the mounting bracket 20.

The mounting bracket 20 preferably has a bottom wall 26 and spaced side panels 28, 30 extending upwardly from the bottom wall. The bottom wall 26 includes a rear edge 32 and spaced slots 34, 36 that preferably extend in a parallel manner with respect to the rear edge. The slots 34 and 36 are in alignment with spaced openings 38 and 40, respectively, of the toilet bowl 16 when the mounting bracket 20 is positioned on the seat mounting area 22 of the toilet bowl 16. The slots 34, 36 and openings 38, 40 are sized for accepting many types of conventional fasteners which can be in the form of screws or bolts 42. Nuts 44 are received on the screws 42 underneath the seat mounting area 22 in a conventional manner for securing the mounting bracket 20 to the toilet bowl 16. The lateral extension of the slots 34, 36 accommodates different toilet bowl hole spacings and sizes that may be present because of variations in tolerances during manufacture as well as different toilet bowl configurations or designs. Accordingly, the mounting bracket 20 is adaptable for use with a wide variety of toilet bowl shapes and sizes. Other attachment means including adhesives, clamps, and so on may additionally or alternatively be used to secure the bracket 20 to the toilet bowl 16.

Figure 5:
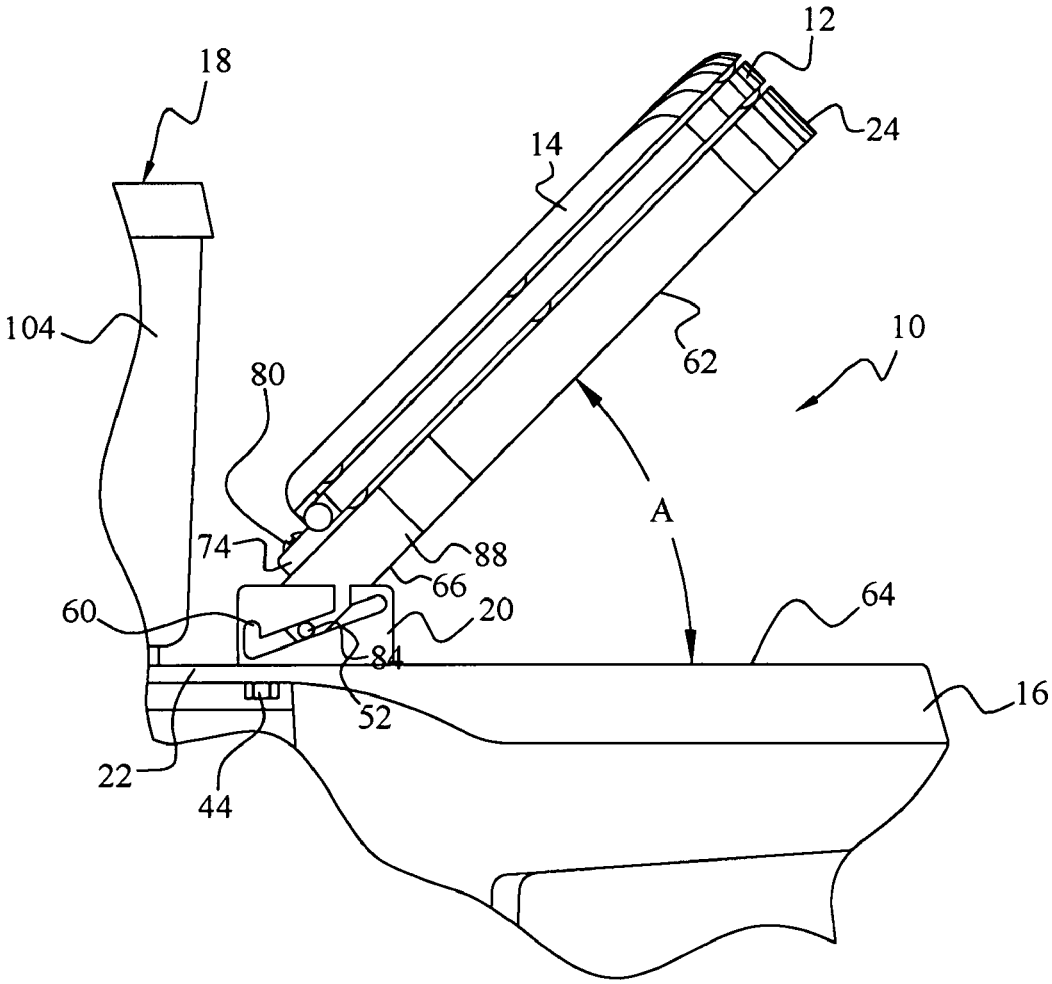
FIG. 5 is a side elevational view similar to FIG. 4 showing further steps of installation of the seat elevator with accompanying toilet seat and lid to the mounting bracket.
Figure 5A:
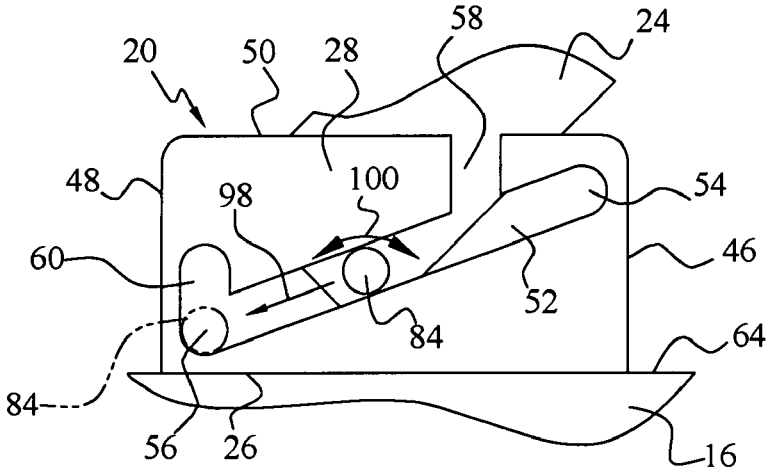
FIG. 5A is an enlarged partial side elevational view of FIG. 5 showing movement of a mounting projection within an elongate slot of the mounting bracket during installation of the seat elevator.

With additional reference to FIG. 5A, each side panel 28, 30 (only side panel 28 shown in FIG. 5A) of the mounting bracket 20 preferably includes a forward edge 46 and a rear edge 48 that extend upwardly from the bottom wall 26 and an upper edge 50 that extends between the forward and rear edges. An elongate slot 52 extends diagonally from a first slot position 54 proximal the forward edge 46 and upper edge 50 to a second slot position 56 proximal the rear edge 48 and bottom wall 26. A first slot segment 58 extends from the upper edge 50 of the side panel to the elongate slot 52, preferably between the first and second slot positions. A second slot segment 60 is spaced rearwardly of the first slot segment 58 and preferably extends toward the upper edge 50 from the second slot position 56 of the elongate slot 52. The purpose of the elongate slot and slot segments will be described in greater detail below.

With particular reference to FIG. 2, the seat elevator 24 is preferably of lightweight, hollow construction and includes a generally ring-shaped seat support portion 62 that is adapted to rest on or otherwise be supported by an upper surface 64 of the toilet bowl 16 and an elevator mounting portion 66 that extends rearwardly of the ring-shaped portion 62. Preferably, the seat support portion 62 and mounting portion 66 form a unitary structure but may alternatively be formed separately and connected together through mechanical fasteners, brackets, adhesives, welding, or any other well-known connection means.

The mounting portion 66 includes a rear wall 68 and spaced slots 70, 72 that preferably extend parallel with the rear wall. The slots 70 and 72 preferably extend through the mounting portion 66 and are in alignment with spaced openings 74 and 76, respectively, of conventional seat hinges 78 when the seat 12 and lid 14 are aligned over the seat support portion 62. The slots 70, 72 and openings 74, 76 are sized for accepting screws or bolts 80. Nuts 82 are received on the screws 80 underneath the mounting portion 66 in a conventional manner for securing the mounting bracket 20 to the toilet bowl 16. If desired, the nuts 82 may be recessed into the bottom of the mounting portion 66. The lateral extension of the slots 70, 72 accommodate different toilet seat hinge spacings due to variations in tolerances during manufacture as well as different toilet seat and/or hinge configurations. In accordance with a further embodiment of the invention, the slots 70, 72 and nuts 82 may be replaced with threaded openings formed in the mounting portion 66 to directly receive the screws 80.

The mounting portion 66 also includes mounting projections 84 and 86 that extend outwardly from opposite side panels 88 and 90, respectively. Each mounting projection 84, 86 is preferably cylindrical in shape and is sized for reception into one of the elongate slots 52 and its associated slot segments 58, 60. Spaced grooves 92, 94 are formed in the seat elevator 24 at the junction of the ring-shaped portion 62 and the mounting portion 66 for receiving the side panels 28, 30 of the mounting bracket 20 when the seat elevator 24 is connected to the mounting bracket 20.

Figure 3:
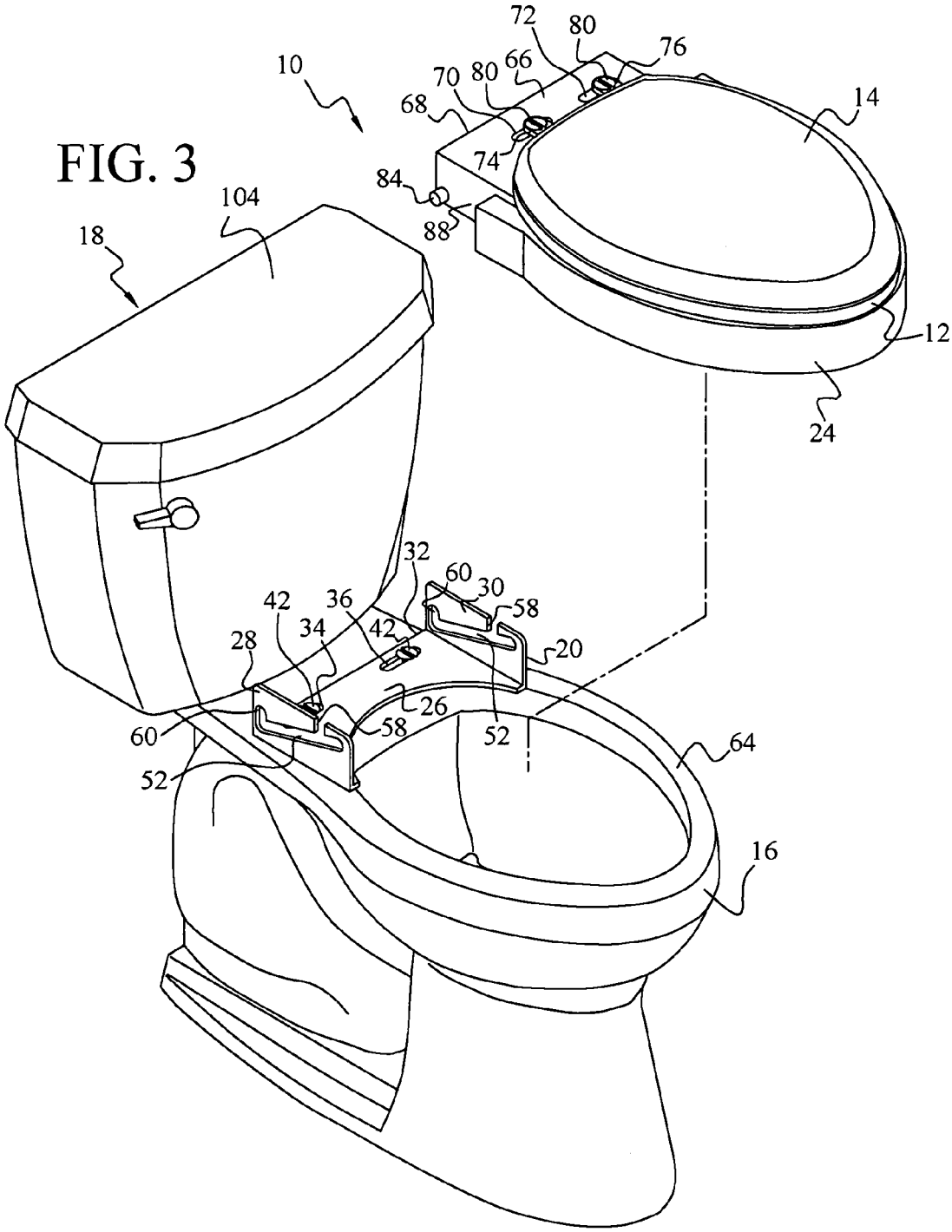
FIG. 3 is an isometric view of the elevator assembly partially assembled to the toilet and accompanying toilet seat and lid.
Figure 4:
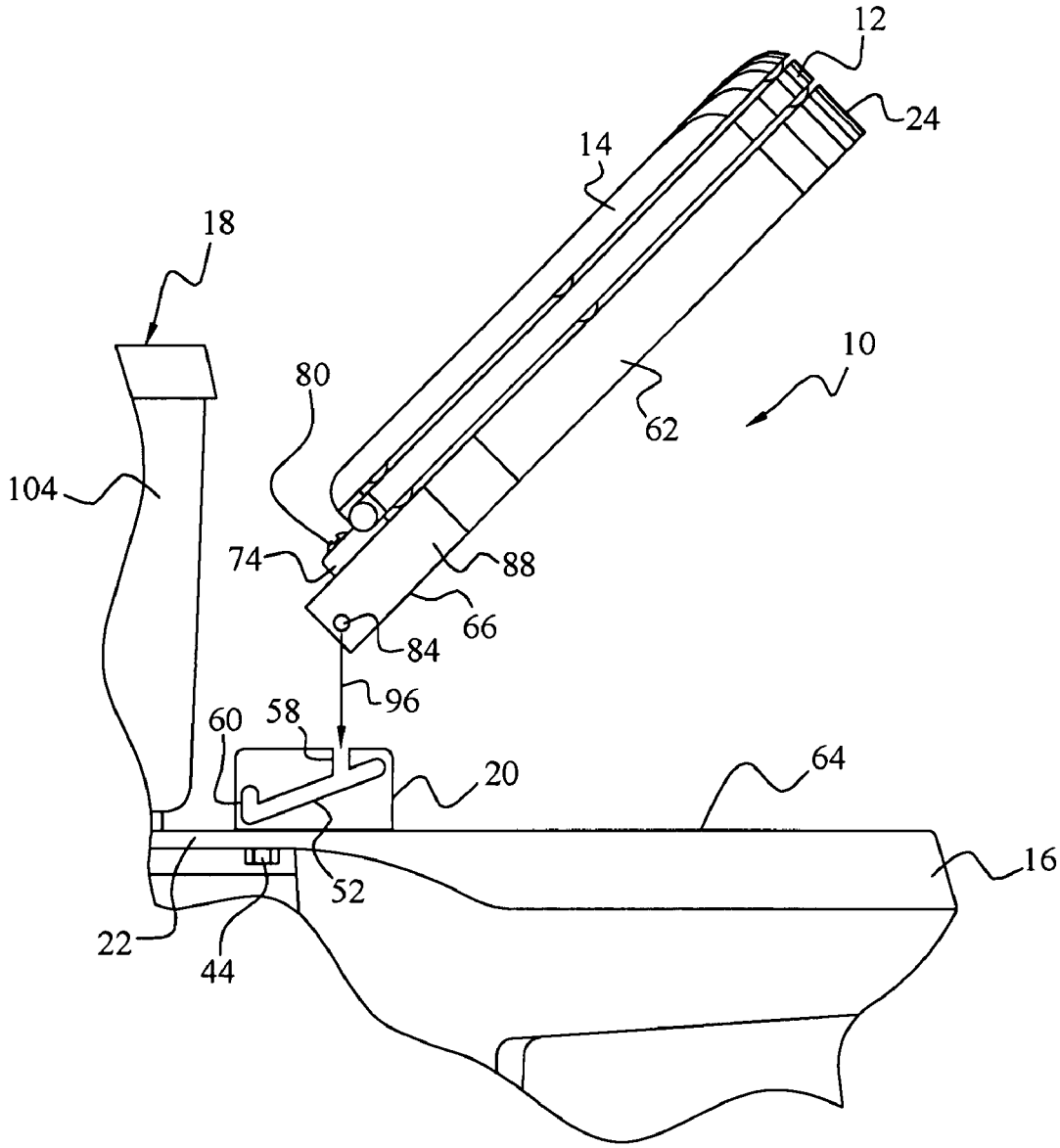
FIG. 4 is a side elevational view of the elevator assembly and a portion of the toilet, showing the manner in which the seat elevator is attached to a mounting bracket which is in turn mounted on the toilet bowl.
Figure 6:
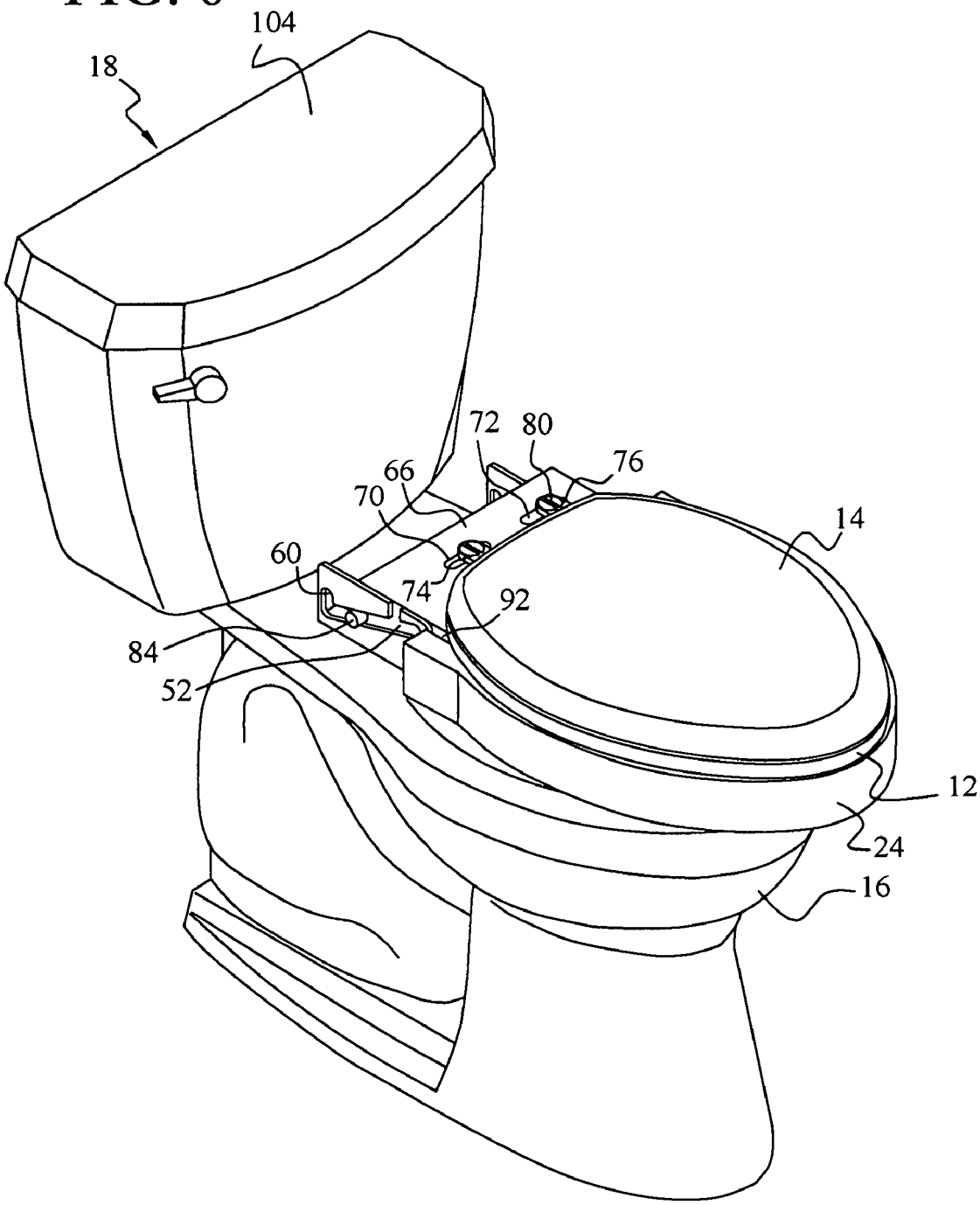
FIG. 6 is an isometric view of a seat elevator with accompanying toilet seat and lid in a horizontal position that may be assumed during installation.

Referring now to FIGS. 3-8, a method of connecting the elevator assembly 10 to the toilet bowl 16 is illustrated. The mounting bracket 20 is first secured to the seat mounting area 22 of the toilet bowl 16 in the manner as previously described, as shown in FIGS. 3 and 4. For convenience, the toilet seat 12 and lid 14 may be pre-mounted to the seat elevator 24, so as to form a respective sub-assembly in the manner as previously described before connecting the seat elevator to the mounting bracket 20. The seat elevator sub-assembly, is then moved over the toilet bowl 16 until the mounting projections 84, 86 are aligned with the first slot segments 58 of the mounting bracket side panels 28, 30. Once aligned, the seat elevator 24 is then lowered in a direction as represented by arrow 96 (FIG. 4), until the mounting projections 84, 86 are positioned in the respective elongate slots 52. Subsequently, the seat elevator 24 is slid downwardly and rearwardly toward the second slot position 56, as denoted by arrow 98 in FIG. 5A, with the mounting projections 84, 86 guiding movement of the seat elevator 24 along their respective elongate slots 52. The rotational ability of the mounting projections 84, 86 within their respective slots 52, as represented by an arrow 100 in FIG. 5A, allows the seat elevator 24 to be installed on the bracket 20 at an adjustable angle A (FIG. 5) convenient to the installer. In this manner, the seat elevator 24 can be connected to the bracket 20 in a more natural upright position. This reduces the possibility of back strain or related injuries that may otherwise occur if the installer and user is required to bend over during installation. As shown in FIG. 6, if an attempt is made to install the seat elevator in a horizontal position, further rearward movement of the mounting projections 84, 86 in their respective slots 52 is inhibited due to the sloping nature of the slots and the position of the mounting projections on the mounting portion 66 of the seat elevator 24. Accordingly, the present embodiment discourages a user or installer from assuming a potentially unsafe bent-over position during installation of the seat elevator 24 to the mounting bracket 20.

Figure 7:
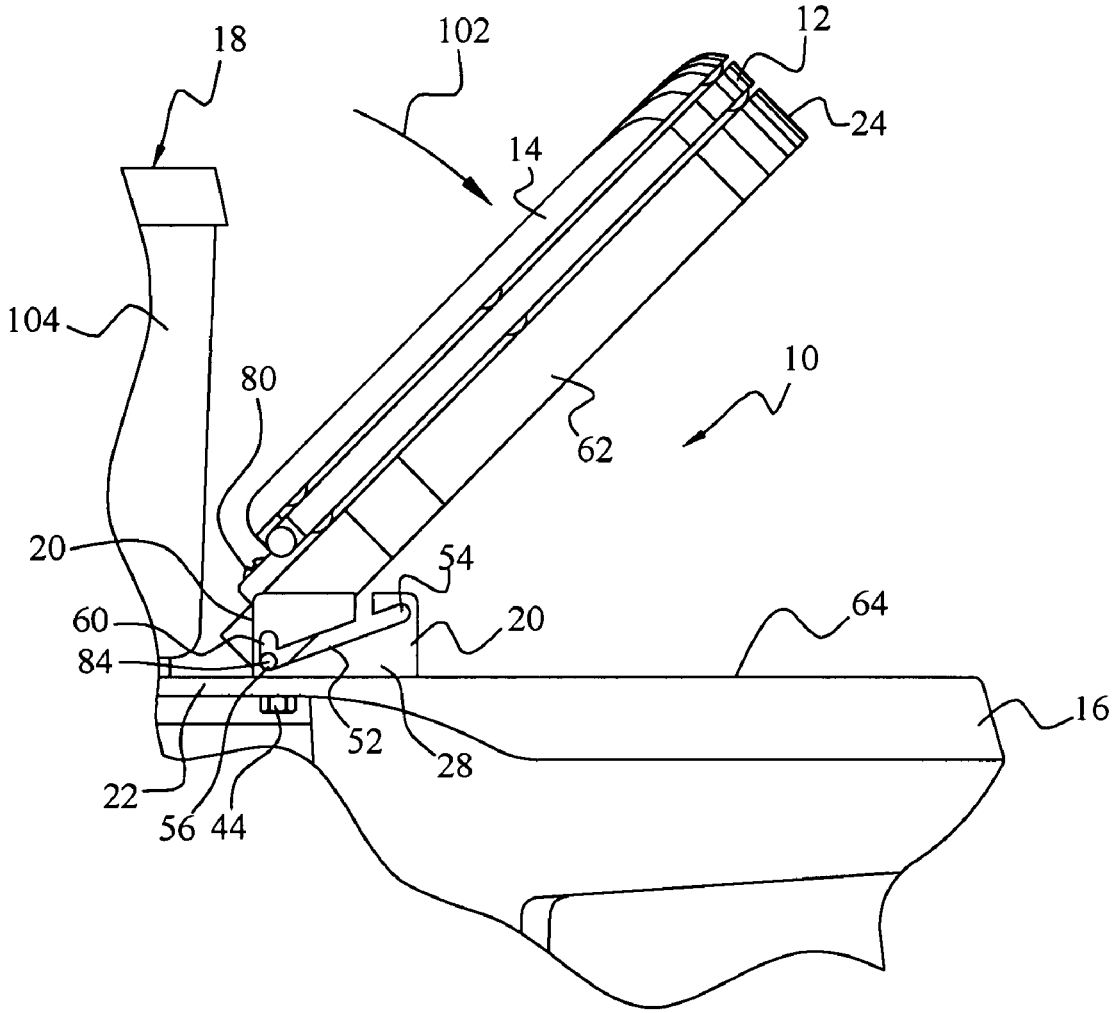
FIG. 7 is a side elevational view similar to FIG. 5 showing further movement of the seat elevator with accompanying toilet seat and lid during installation.
Figure 8:
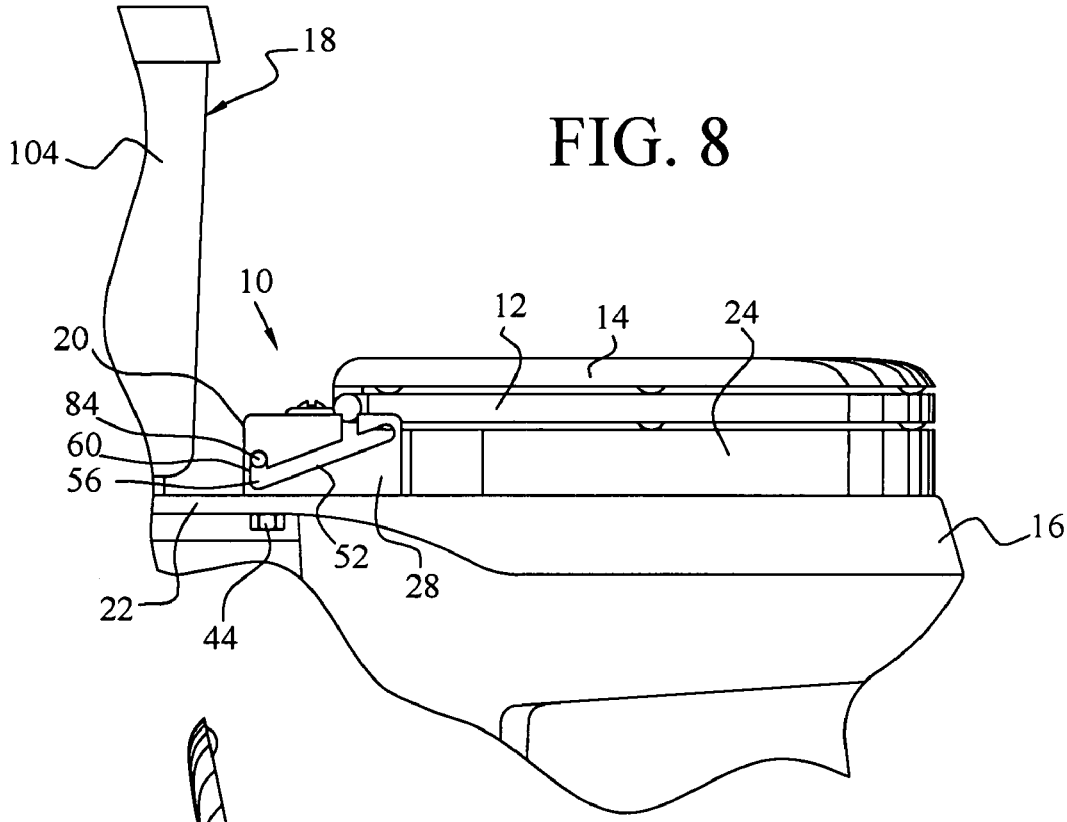
FIG. 8 is a side elevational view of the elevator assembly in the installed horizontal lowered position on the toilet bowl.
Figure 9:
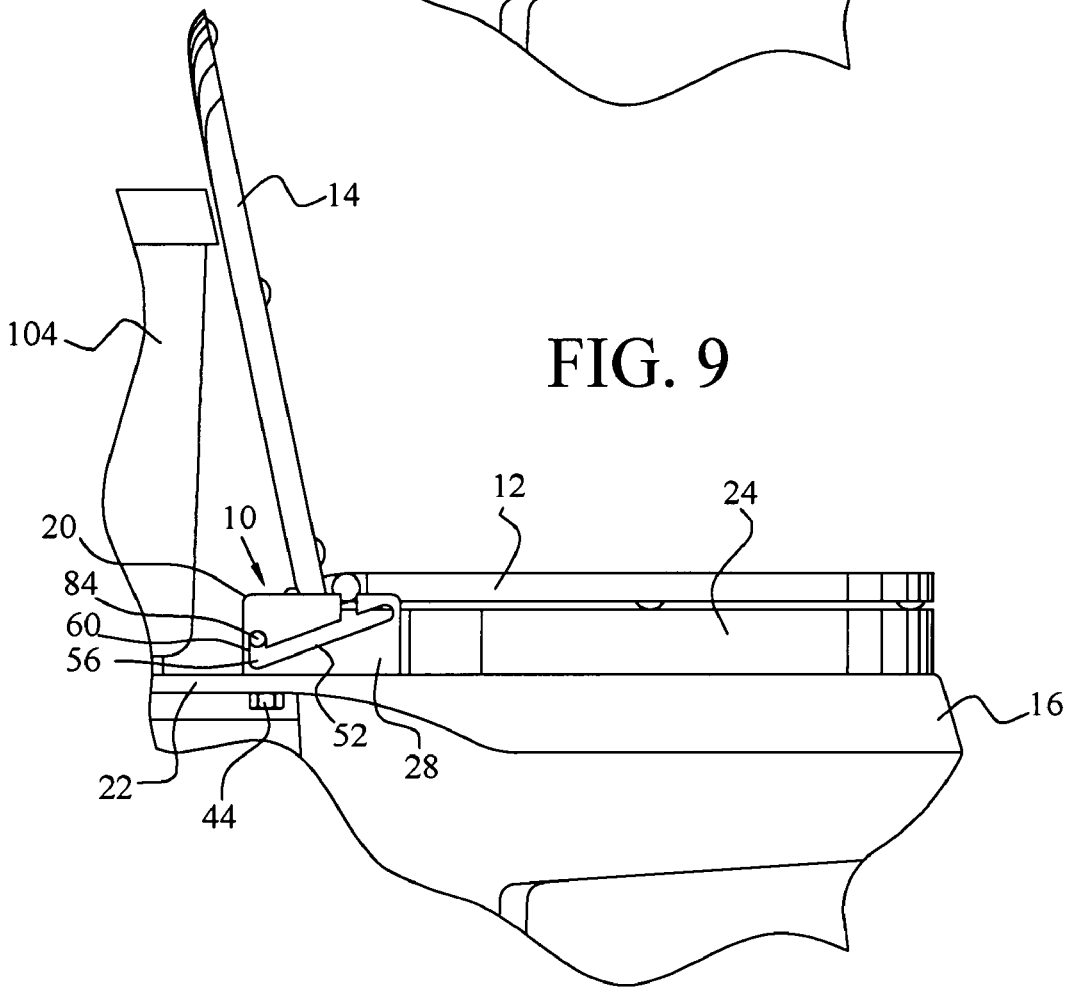
FIG. 9 is a side elevational view of the elevator assembly showing the lid in one upright position.
Figure 10:
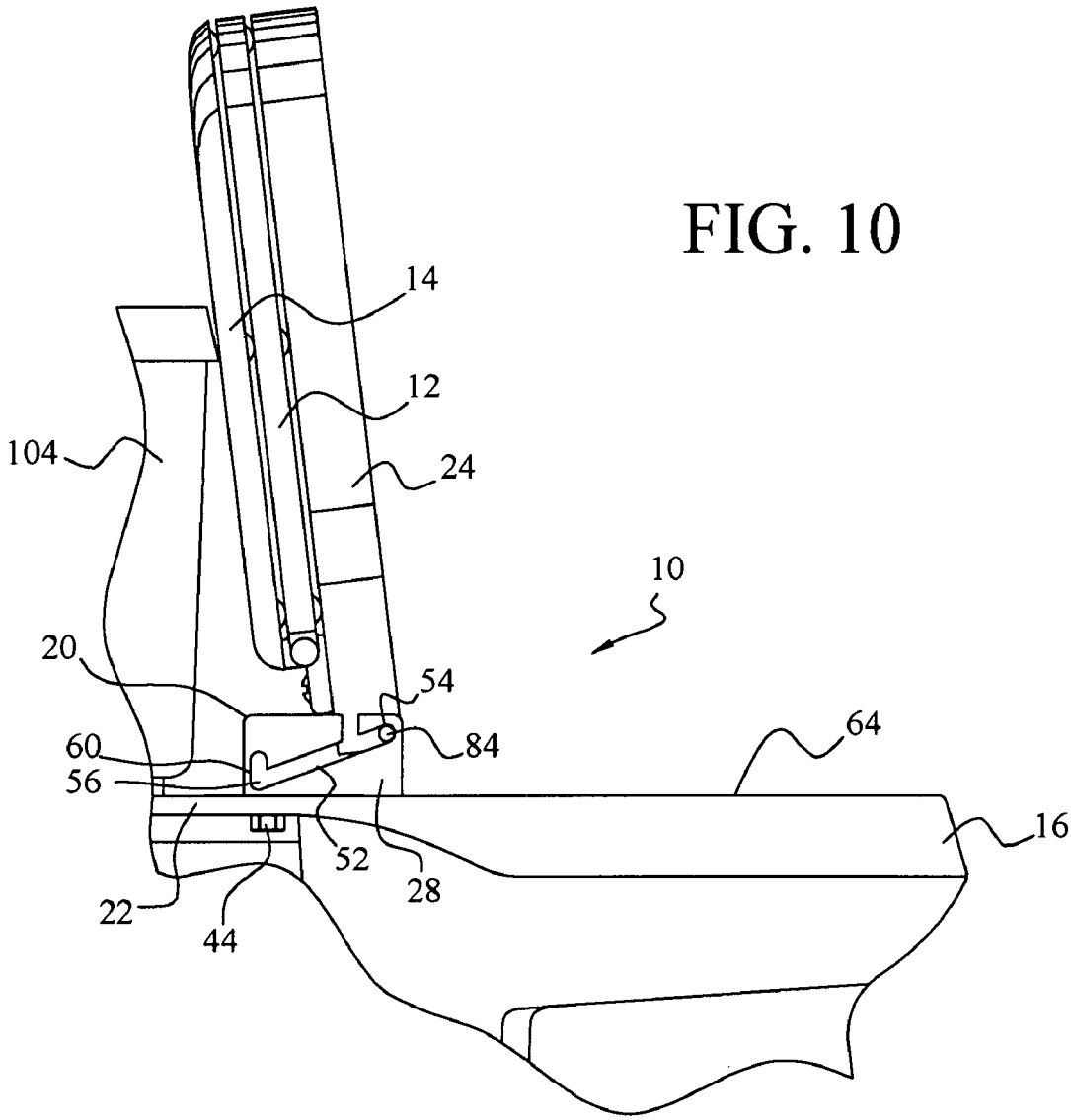
FIG. 10 is a side elevational view showing the seat elevator with accompanying toilet seat and lid in another upright position.

As shown in FIG. 7, when the mounting projections 84, 86 have reached the second slot position 56, the seat elevator 24 and accompanying toilet seat 14 and lid 12 can be rotated in a direction, as represented by arrow 102, to the lowered or horizontal position shown in FIG. 8. In this position, the mounting projections 84, 86 are located at the upper part of the respective second slot segments 60. In this manner the seat elevator 24 is secured against sliding movement along the elongate slots 52. Subsequently, as shown in FIG. 9, the lid 14 can be rotated to an open position for use. Likewise, as shown in FIG. 10, the seat elevator with the associated seat and lid can be slid diagonally and forwardly along the slots 52 until the mounting projections are located at the first slot position 54. The seat elevator with the associated seat and lid can then be rotated so that the lid 14 rests against the tank 104 of the toilet 18. This stable, over-center position ensures that the seat elevator 24 and the accompanying seat and lid can be moved and rotated for use as a urinal and/or for cleaning without removal from the mounting bracket 20. Also, the seat elevator with toilet seat and lid may be easily and conveniently removed from the bracket 20 for cleaning or replacement simply by reversing the installation procedure as described above.

Figure 11:
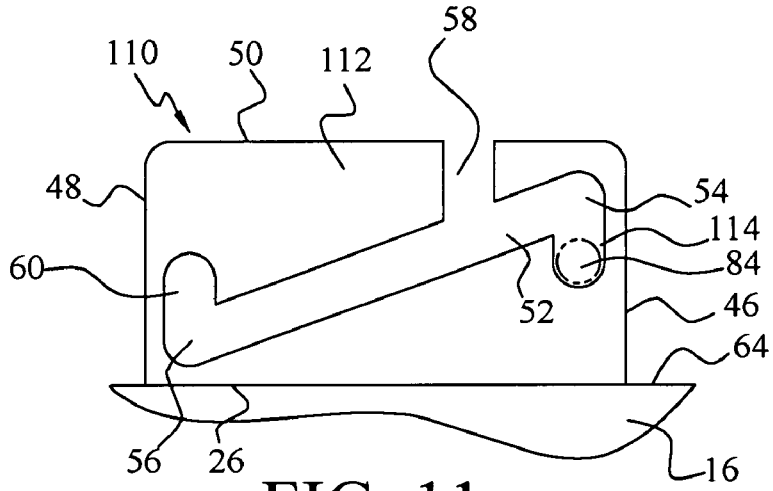
FIG. 11 is an enlarged side elevational view of a mounting bracket in accordance with a further preferred embodiment of the invention.

With reference now to FIG. 11, in order to provide even greater stability in the upright position, a mounting bracket 110 in accordance with a further embodiment of the invention is illustrated. The mounting bracket 110 is similar in construction to the mounting bracket 20 of the previous embodiment, with the exception that each side panel 112 is provided with a third slot segment 114 that extends downwardly from the elongate slot 52, preferably from the first slot position 54. When the seat elevator and accompanying seat and lid are raised to lean against the tank, as illustrated in the FIG. 10 position, the mounting projections 84, 86 (projection 84 shown in phantom line in FIG. 11) are located in the third slot segment 114 of the respective side panels 28, 30. This secures the seat elevator 24 against undesirable at this time sliding movement along the elongate slots 52.

Figure 12:
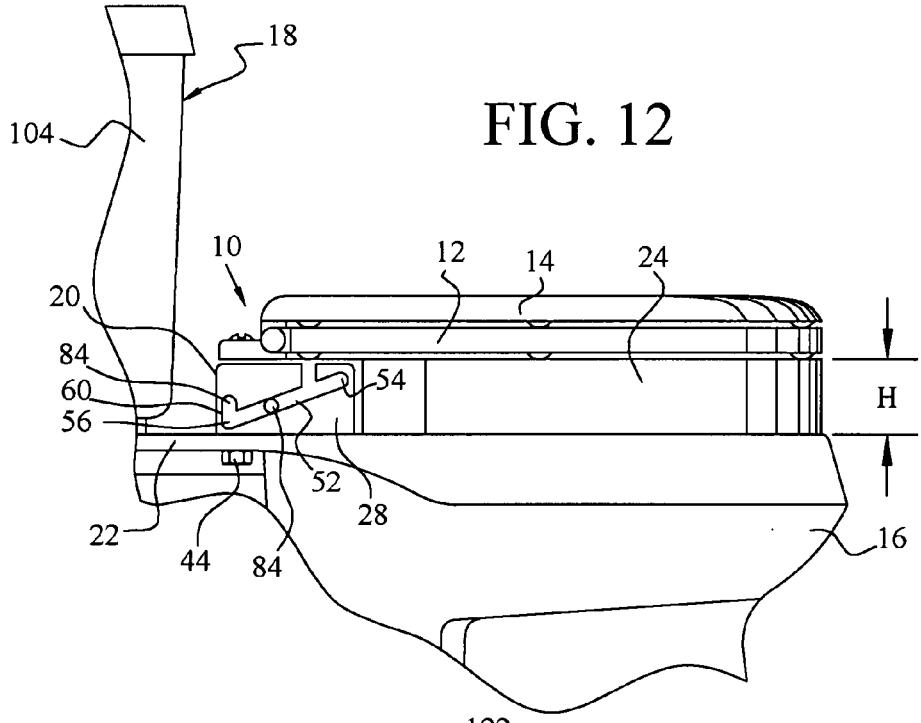
FIG. 12 is a side elevational view of an elevator assembly mounted to the toilet bowl and showing the manner in which the mounting bracket can accommodate seat elevators of varying height.

As shown in FIG. 12, due to the sloping nature of the elongate slot 52, the mounting bracket of any of the preceding or following embodiments is particularly useful for accommodating seat elevators 24 of various heights "H". When a seat elevator of a greater height is used, the mounting projection 84 is located in the elongate slot 52 somewhere between the first slot position 54 and second slot position 56. Although not shown, the other mounting projection 86 would be positioned at a similar location in the respective side panel 30. In this position, forward and rear sliding movement of the seat elevator 24 with accompanying seat 12 and lid 14 along the toilet bowl 16 is prevented when the seat elevator is in the lowered position. This is primarily due to the engagement between the elevator 24 and the upper surface of the toilet bowl 16. Accordingly, it is anticipated that the mounting bracket 20 of the present invention can accommodate a wide variety of seat elevator heights without modification. However, it will be understood that different mounting brackets with different elongate slot elevations may be provided for different seat heights when it is desirous to lock the mounting projections 84, 86 in their respective second slot segments 60.

Figure 13:
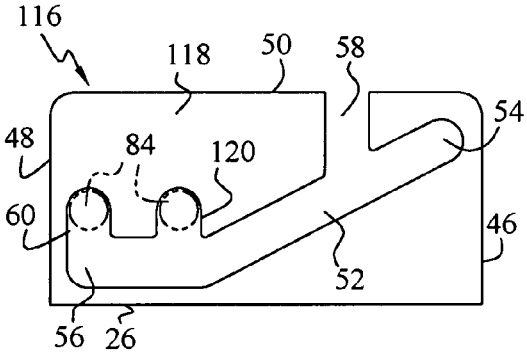
FIG. 13 is an enlarged side elevational view of a mounting bracket in accordance with yet a further preferred embodiment of the invention.

The present invention provides seat elevator arrangement capable of accommodating various configurations of the toilet bowls. Referring now to FIG. 13, wherein a mounting bracket 116 in accordance with a further embodiment of the invention is illustrated. The mounting bracket 116 is similar in construction to the mounting bracket 20 of the previous embodiment, with the exception that each side panel 118 is provided with a third slot segment 120 that extends upwardly toward the upper edge 50 from the elongate slot 52, preferably between the first slot segment 58 and second slot segment 60. With this arrangement, the mounting bracket 116 can be mounted on either round or elongate toilet bowls with the mounting projections 84, 86 (only 84 shown in FIG. 13 in phantom line) located in the slot segment 60 for round toilet bowls and in the slot segment 120 for elongate toilet bowls. It will be understood that the slot segment 120 can be located at a different position than that shown. Still further, more than one slot segment 120 may be provided to accommodate a wide variety of toilet bowl sizes and configurations.

Figure 14:
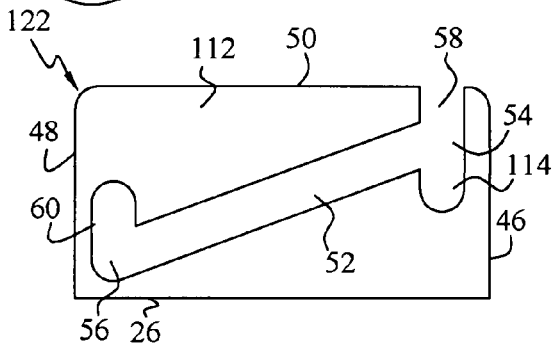
FIG. 14 is an enlarged side elevational view of a mounting bracket in accordance with another preferred embodiment of the invention.

Referring now to FIG. 14, a mounting bracket 122 in accordance with still another embodiment of the invention is illustrated. The mounting bracket 122 is similar in construction to the mounting bracket 110 (FIG. 11) of the previous embodiment, with the exception that the first slot segment 58 is in alignment with the third slot segment 114. With this arrangement, the seat elevator with accompanying toilet seat and lid may be installed in the over-center position, as shown in FIG. 10, without the need to lift the seat elevator to the first slot position as in the previous embodiments. It will therefore be understood that the first slot segment 58 may be located anywhere along the upper edge 50 of the mounting bracket between the first and second slot positions 54, 56. It will be further understood that the first slot segment 58 may intersect with one of the forward and rear edges 46, 48 instead of the upper edge 50.

Figure 15:
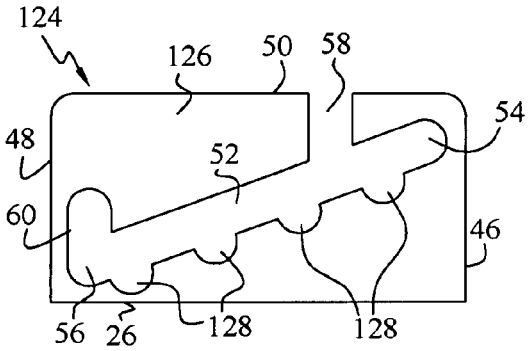
FIG. 15 is an enlarged side elevational view of a mounting bracket in accordance with still another preferred embodiment of the invention.

Referring now to FIG. 15, a mounting bracket 124 in accordance with still further embodiment of the invention is illustrated. The mounting bracket 124 is similar in construction to the mounting bracket 20 previously described, with the exception that each side panel 126 includes a series of slot segments 128 that extend downwardly from the elongate slot 56. Each slot segment 128 is preferably semi-circular in shape for receiving the mounting projections 84, 86 during assembly or disassembly of the seat elevator with respect to the mounting bracket 124. In this embodiment the seat elevator can be moved and/or rotated in controlled, discrete stops or positions.

Figure 16:
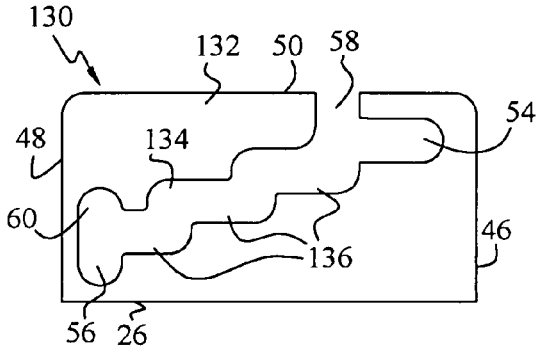
FIG. 16 is an enlarged side elevational view of a mounting bracket in accordance with an additional preferred embodiment of the invention.

Referring now to FIG. 16, a mounting bracket 130 in accordance with a further embodiment of the invention is illustrated. The mounting bracket 130 is similar in construction to the mounting bracket 20 previously described, with the exception that the side panel 132 includes an elongate slot 134 with a series of steps 136 located between the first slot position 54 and second slot position 56. With this arrangement, the seat elevator can be moved in controlled, discrete steps during assembly/disassembly. Furthermore, the mounting bracket 130 can be adapted to accommodate a wide variety of toilet bowl shapes, sizes, and elevator thicknesses.

Figure 17:
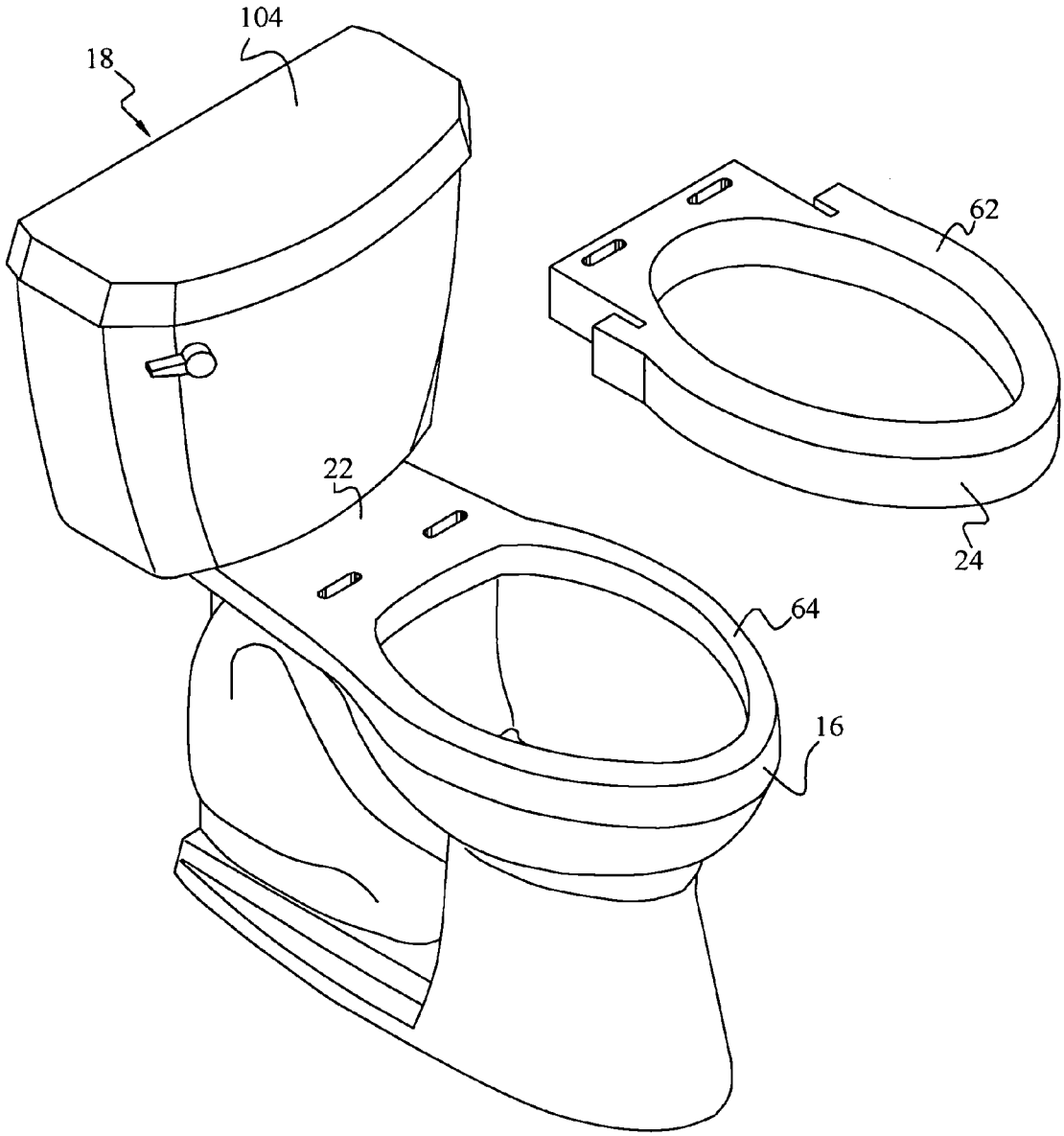
FIG. 17 is an exploded view of the elevator without the mounting bracket for mounting to the toilet.

FIG. 17 shows the embodiment, illustrating that the seat elevator 24 can be mounted to the toilet bowl 16 without the previously discussed mounting bracket.

It will be understood that the term "preferably" as used throughout the specification refers to one or more exemplary embodiments of the invention and therefore is not to be interpreted in any limiting sense. It will be further understood that the term "connect" and its various derivatives as may be used throughout the specification refer to components that may be joined together either directly or through one or more intermediate members. In addition, terms of orientation and/or position as may be used throughout the specification relate to relative rather than absolute orientations and/or positions.

It will be appreciated by those skilled in the art that changes could be made to the embodiments described above without departing from the broad inventive concept thereof. By way of example, only one of the side panels may be provided with the first slot segment while the other side panel is void of the first slot segment. In this manner, one of the mounting projections may be directly inserted into the elongate slot while the other mounting projection is inserted into the elongate slot via the first slot segment. It will be understood, therefore, that this invention is not limited to the particular embodiments disclosed, but is intended to cover modifications within the spirit and scope of the present invention as defined by the appended claims.

What is claimed is:

1. A toilet seat elevator assembly comprising:

a seat elevator having a generally ring-shaped portion for resting on a toilet bowl and a mounting portion extending rearwardly of the ring-shaped portion, the mounting portion having opposing mounting projections; and a bracket including a bottom wall adapted for securement to the toilet bowl and spaced side panels extending upwardly from the bottom wall, each said side panel having forward and rear edges extending upwardly from the bottom wall and an upper edge extending between the forward and rear edges, and an elongate slot extending diagonally within each said side panel between the forward and rear edges, whereby each said elongate slot is slidably and rotatably receiving the mounting projections of the mounting portion, to thereby facilitate adjustment and removal of the seat elevator with respect to the toilet bowl, the seat elevator being slidably and rotatably mounted to the bracket, wherein each said elongate slot extends diagonally from a first slot position proximal the forward and upper edges to a second slot position proximal the rear edge and bottom wall, wherein at least one of the side panels includes a first slot segment that extends from the upper edge to the elongate slot for receiving one of the mounting projections when the mounting portion of the seat elevator is installed on the bracket, wherein the first slot segment is located between the first and second slot positions, wherein each side panel further includes a second slot segment spaced rearwardly of the first slot segment, the second slot segment extending vertically from the second slot position toward the upper edge from the elongate slot, each mounting projection being positioned in a respective second slot segment when the toilet seat elevator is in a lowered position on the toilet bowl to thereby secure the seat elevator against sliding movement along the elongate slot.

2. A toilet seat elevator assembly according to claim 1, wherein said at least one mounting projection is located at the first slot position when the seat elevator is rotated to a raised position from a lowered position.

3. A toilet seat elevator assembly according to claim 1, wherein said at least one mounting projection is movable within said second slot segment from a lower position at said elongate slot to an elevated position toward the upper edge to prevent said sliding movement.

4. A toilet seat elevator assembly according to claim 1, and further comprising a third slot segment extending from the first slot position toward the bottom wall, wherein said at least one mounting projection is located in the third slot segment when the seat elevator is rotated to a raised position from a lowered position to thereby securely hold the seat elevator in the raised position.

5. A toilet seat elevator assembly according to claim 1, wherein the at least one side panel further includes a third slot segment spaced forwardly of the second slot segment, the third slot segment extending toward the upper edge from the elongate slot, said at least one mounting projection being positioned in the third slot segment to thereby adjust the position of the seat elevator when mounted on an elongate toilet bowl.

6. A toilet seat elevator assembly according to claim 1, and further comprising a third slot segment positioned forwardly of the second slot segment and extending from the elongate slot toward the bottom wall, wherein each mounting projection is located in its respective third slot segment when the seat elevator is rotated to a raised position from a lowered position to thereby securely hold the seat elevator in the raised position.

7. A toilet seat elevator assembly comprising:

a seat elevator having a generally ring-shaped portion for resting on a toilet bowl and a mounting portion extending rearwardly of the ring-shaped portion, the mounting portion having opposing mounting projections; and a bracket including:

a bottom wall adapted for securement to the toilet bowl; spaced side panels extending upwardly from the bottom wall, each side panel having forward and rear edges extending upwardly from the bottom wall and an upper edge extending between the forward and rear edges, each side panel including:

an elongate slot extending diagonally within each said side panel from a first slot position proximal the upper and forward edges to a second slot position proximal the rear edge and bottom wall, whereby each said elongate slot is slidably and rotatably receiving the mounting projections of the mounting portion;

a first slot segment extending from the upper edge to the elongate slot for receiving one of the mounting projections during installation of the mounting portion of the seat elevator on the bracket, wherein the first slot segment is located between the first and second slot positions; and a second slot segment spaced rearwardly of the first slot segment, the second slot segment extending vertically from the second slot position toward the upper edge from the elongate slot, each mounting projection being positioned in its respective second slot segment when the toilet seat elevator is in a lowered position on the toilet bowl to thereby secure the seat elevator against sliding movement along the elongate slot when in use.

8. A toilet seat elevator assembly according to claim 7, wherein each mounting projection is located at its respective first slot position when the seat elevator is rotated to a raised position from a lowered position.

9. A toilet seat elevator assembly according to claim 7, wherein each side panel further comprises a third slot segment extending from the first slot position toward the bottom wall, wherein each mounting projection is located in its respective third slot segment when the seat elevator is rotated to a raised position from the lowered position to thereby securely hold the seat elevator in the raised position.

10. A toilet seat elevator assembly according to claim 7, wherein each side panel further comprises a third slot segment spaced forwardly of the second slot segment, the third slot segment extending toward the upper edge from the elongate slot, each mounting projection being positioned in its respective third slot segment to thereby adjust the position of the seat elevator when mounted on an elongate toilet bowl.

11. A toilet seat elevator assembly according to claim 10, wherein each side panel further comprises a fourth slot segment extending from the first slot position toward the bottom wall, wherein each mounting projection is located in its respective fourth slot segment when the seat elevator is rotated to a raised position from the lowered position to thereby securely hold the seat elevator in the raised position.

* * * * *